US011335152B2

(12) United States Patent
Tinney et al.

(10) Patent No.: US 11,335,152 B2
(45) Date of Patent: May 17, 2022

(54) METHOD AND APPARATUS FOR TRANSPORTABLE VOTING EQUIPMENT TO PROVIDE CURBSIDE VOTING, MOBILE VOTING, AND PRINTING OF PRINTED VOTE RECORDS

(71) Applicant: Hart InterCivic, Inc., Austin, TX (US)

(72) Inventors: Drew E. Tinney, Austin, TX (US); James M. Canter, Austin, TX (US); Denton L. Simpson, Round Rock, TX (US)

(73) Assignee: Hart InterCivic, Inc., Austin, TX (US)

( * ) Notice: Subject to any disclaimer, the term of this patent is extended or adjusted under 35 U.S.C. 154(b) by 80 days.

(21) Appl. No.: 17/021,096

(22) Filed: Sep. 15, 2020

(65) Prior Publication Data

US 2021/0142606 A1 May 13, 2021

Related U.S. Application Data

(60) Provisional application No. 62/932,554, filed on Nov. 8, 2019.

(51) Int. Cl.
*G07C 13/00* (2006.01)

(52) U.S. Cl.
CPC ..... *G07C 13/00* (2013.01)

(58) Field of Classification Search
CPC ..... G07C 13/00
USPC ..... 235/51
See application file for complete search history.

(56) References Cited

U.S. PATENT DOCUMENTS

| | | | | |
|---|---|---|---|---|
| 5,483,276 | A | 1/1996 | Brooks et al. | |
| 5,598,323 | A | 1/1997 | Muller | |
| 5,878,399 | A | 3/1999 | Peralto | |
| 6,250,548 | B1 | 6/2001 | McClure et al. | |
| 6,609,207 | B1 | 8/2003 | Cromer et al. | |
| 2002/0074399 | A1* | 6/2002 | Hall | G07C 13/00 235/386 |
| 2004/0238632 | A1* | 12/2004 | Homewood | G07C 13/00 235/386 |
| 2012/0042099 | A1 | 2/2012 | Wong et al. | |
| 2012/0190406 | A1 | 7/2012 | Chen | |
| 2013/0014232 | A1 | 1/2013 | Louboutin et al. | |
| 2014/0052505 | A1 | 2/2014 | Canter et al. | |

OTHER PUBLICATIONS

Themes, "ES&S EVS 6.0.0.0", Jul. 2018, 4 pgs.

(Continued)

*Primary Examiner* — Daniel A Hess
(74) *Attorney, Agent, or Firm* — Egan, Enders & Huston LLP.

(57) ABSTRACT

An electronic voting system that includes transportable voting equipment is described. Such transportable voting equipment includes a carrier that may be transportable and easily moved to enable curbside/mobile voting. The carrier may be ergonomically shaped for usage by passing through a vehicle window and resting in a voter's lap. In one embodiment, the carrier may include a printer to produce a printed vote record. The electronic voting system may include the use of a base station (for example located inside a polling building), the curbside/mobile carrier, and a smart panel that is dockable and removable to/from both the base station and the curbside/mobile carrier.

34 Claims, 12 Drawing Sheets

(56) References Cited

OTHER PUBLICATIONS

ES&S, "Express ote Operator's Guide", Document Version 4.0; Firmware Version 1.4; Mar. 20, 2014, 268 pgs.
ES&S, "ExpressVote, Universal Voting System as a Marker", 2016, 2 pgs.

* cited by examiner

METHOD AND APPARATUS FOR TRANSPORTABLE VOTING EQUIPMENT TO PROVIDE CURBSIDE VOTING, MOBILE VOTING, AND PRINTING OF PRINTED VOTE RECORDS

This application claims priority to U.S. Provisional Patent Application No. 62/932,554, entitled, "Method and Apparatus For Transportable and Useable Voting Equipment to Provide Curbside Voting and Printing of Printed Vote Records," filed Nov. 8, 2019; the disclosure of which is expressly incorporated herein, in its entirety, by reference.

BACKGROUND OF THE INVENTION

The present disclosure relates to the voting systems for elections. More specifically, it provides a system and method for providing a voting system which incorporates transportable voting stations, such as for example, for "curbside voting" and "mobile voting."

A variety of electronic voting systems are well known. Electronic systems include, for example, direct recording electronic (DRE) voting systems that electronically record votes to directly create an electronic cast vote record. Electronic systems also include, for example, systems in which printed paper vote records are generated based on a voter's electronic vote selections, with the paper vote record then being scanned for creation of the electronic cast vote record and electronic tabulation. The use of printed vote records, however, increases the complexity of the voting process and equipment and makes transportable curbside and mobile voting more difficult. As used herein, an electronic cast vote record is an electronic record that indicates the determined voter's choice or selection in a manner determined in accordance with the voting system. Thus, an electronic cast vote record is an electronic record of a voter's cast voting selections and may be used in the vote tabulation process. Other electronic voting systems are also known for use at polling stations or locations.

The electronic systems utilized at polling locations are often bulky and often require direct cable connections between various components of the systems. As mentioned, the complexity of such systems is enhanced when printed vote records are required. Further, though such systems may be moved from an election office storage location to a particular polling location (for example a precinct voting location), such systems are typically intended to be relatively immobile once the equipment is setup, installed and activated for voting. Because of this, generally the equipment does not provide a satisfactory manner in which a voter may vote from outside the polling location. Need for voting outside the polling location may arise in situations where a voter with disabilities may not easily access the polling location. Another need may arise is an election authority would like to enable "curbside" or "mobile" voting. In curbside or mobile voting, a voter need not enter a polling location building but rather could vote, for example, from a car or in another outside area. Because of the bulk, physical connections, and general lack of transportability of most voting systems when the voting system is installed and setup to accept voters, there is a need for transportable voting stations, such as for example, stations which may enable curbside or mobile voting.

SUMMARY OF THE INVENTION

In one embodiment, the present disclosure describes an electronic voting system that enables transportable voting equipment. Such transportable voting equipment may be transportable and easily moved while the equipment is enabled for voting to occur. In one embodiment, the transportable voting equipment may be used to enable curbside or mobile voting in election processes in which printed vote records are required. In this embodiment, transportable voting equipment is provided that allows poll workers to easily transport (for example to a voter in a vehicle at a curbside) voting equipment and allows the voter to independently make their vote selections, even from outside a polling location. The transportable voting equipment may include a printer to produce a printed vote record. The electronic voting system may include the use of a base station (for example located inside a polling building), transportable voting equipment, and a smart panel that is dockable and removable to/from both the base station and the transportable voting equipment. The transportable voting equipment may include a carrier and a printer. The carrier provides a new housing for the smart panel that is customized for transport to a voter outside of a polling place (for example curbside or mobile voting). The electronic voting system may also include an audio tactile interface (ATI) controller that is transportable as part of the carrier, as part of the smart panel or as a separate stand-alone ATI controller.

In another embodiment, an electronic voting system includes at least three components: a base station utilized within the polling location, a carrier for use with curbside or mobile voting, and a smart panel that may dock both with the base station (for use in a polling place) and with the carrier for transport to and use in another location (for example curbside or other mobile voting locations). Further, in one particular embodiment, the electronic voting system is configured such that a printed record may be created either within the polling location or at the curbside/mobile location.

In another embodiment, transportable voting equipment is provided which comprises a carrier to which a voting smart panel may be attached and docked. The carrier may be configured in a manner that it may be presented to a voter in a manner that it is passed through a voter's open vehicle window to enable curbside voting. Moreover, the carrier may be ergonomically configured for use within a vehicle. For example, the carrier may be sized such that the carrier may be passed to a voter through an open window of a vehicle. Further, the carrier may include side handles for easy gripping the carrier. In addition, the carrier may include at least one curved end such that the carrier may rest upright on a voter's lap, for example when a voter is seated within a vehicle. The carrier may further include a printer so that a voter may receive a printed vote record while voting at a curbside/mobile location.

In a first embodiment, transportable election voting equipment is provided. The transportable election voting equipment may comprise a handheld carrier, the handheld carrier sized to pass through a vehicle window, a housing of the handheld carrier, the housing configured to detachably hold a voting device, and a printer contained within the housing, wherein the handheld carrier is configured such that the printer may be in electrical communication with the voting device when the voting device is held in the handheld carrier.

In a second embodiment, transportable election voting equipment is provided. The transportable election voting equipment may comprise a handheld carrier, the handheld carrier configured to detachably hold a voting device, the handheld carrier having a bottom end and a top end and a printer held by the handheld carrier. The transportable election voting equipment further comprises a shaped region of the bottom end of the handheld carrier, the shaped region providing cutout corners of the bottom end to allow for the bottom end of the handheld carrier to be shaped for resting in a voter's lap and at least one side handle on either a left side of the handheld carrier or the right side of the handheld carrier.

In some embodiments of the transportable election voting equipment described above, the voting device may be a smart panel having a screen. The handheld carrier may further comprise an opening for viewing a screen of the voting device when the voting device is held in the cavity.

In some embodiments, a bottom end of the handheld carrier may be ergonomically configured for resting on a voter's lap. In addition, the bottom end of the handheld carrier may have shaped regions that provide cutout corners of the bottom end. The cutout corners provide a transition from the bottom end of the carrier to a left side of the carrier and a right side of the carrier. The shaped regions may be chamfered regions. Alternatively, the shaped regions may be curved regions.

In the embodiments described above, the housing may contain a cavity for holding the voting device. The handheld carrier may further comprises a rear door providing access to the cavity when the rear door is opened. The handheld carrier may also have at least one side handle and in some embodiments may have two side handles. In some embodiments, the side handles extend at least 50% of the top to bottom length of the handheld carrier. In some embodiments, a height of the handheld carrier is 20 inches or less, a width of the handheld carrier is 20 inches or less and a depth of the handheld carrier is 5 inches or less.

In some embodiments, the transportable election voting equipment further comprises a printer output slot, the printer output slot configured to eject a printed vote record or a marked ballot at a front of the handheld carrier. The printer output slot may be located so that the printed vote record or the marked ballot may be ejected in front of a screen location of the voting device. The transportable election voting equipment of may further comprises a paper landing area formed by edges of the housing to receive the printed vote record or marked ballot after ejection from the printer output slot. A bottom edge of the paper landing area may be angled more than 90 degrees. In some embodiments, the handheld carrier further comprises a rear door, wherein the rear door provides access through which paper for the printer may be loaded, and wherein when the rear door is closed an enclosed paper path is provided.

In some embodiments of the transportable election voting equipment, the handheld carrier further comprises an electrical communication bus such that the printer may be in electrically communication with the voting device when the voting device is held in the handheld carrier.

BRIEF DESCRIPTION OF THE DRAWINGS

A more complete understanding of the present invention and advantages thereof may be acquired by referring to the following description taken in conjunction with the accompanying drawings, in which like reference numbers indicate like features. It is to be noted, however, that the accompanying drawings illustrate only exemplary embodiments of the disclosed concept and are therefore not to be considered limiting of its scope, for the disclosed concept may admit to other equally effective embodiments.

DETAILED DESCRIPTION

Figure 1:
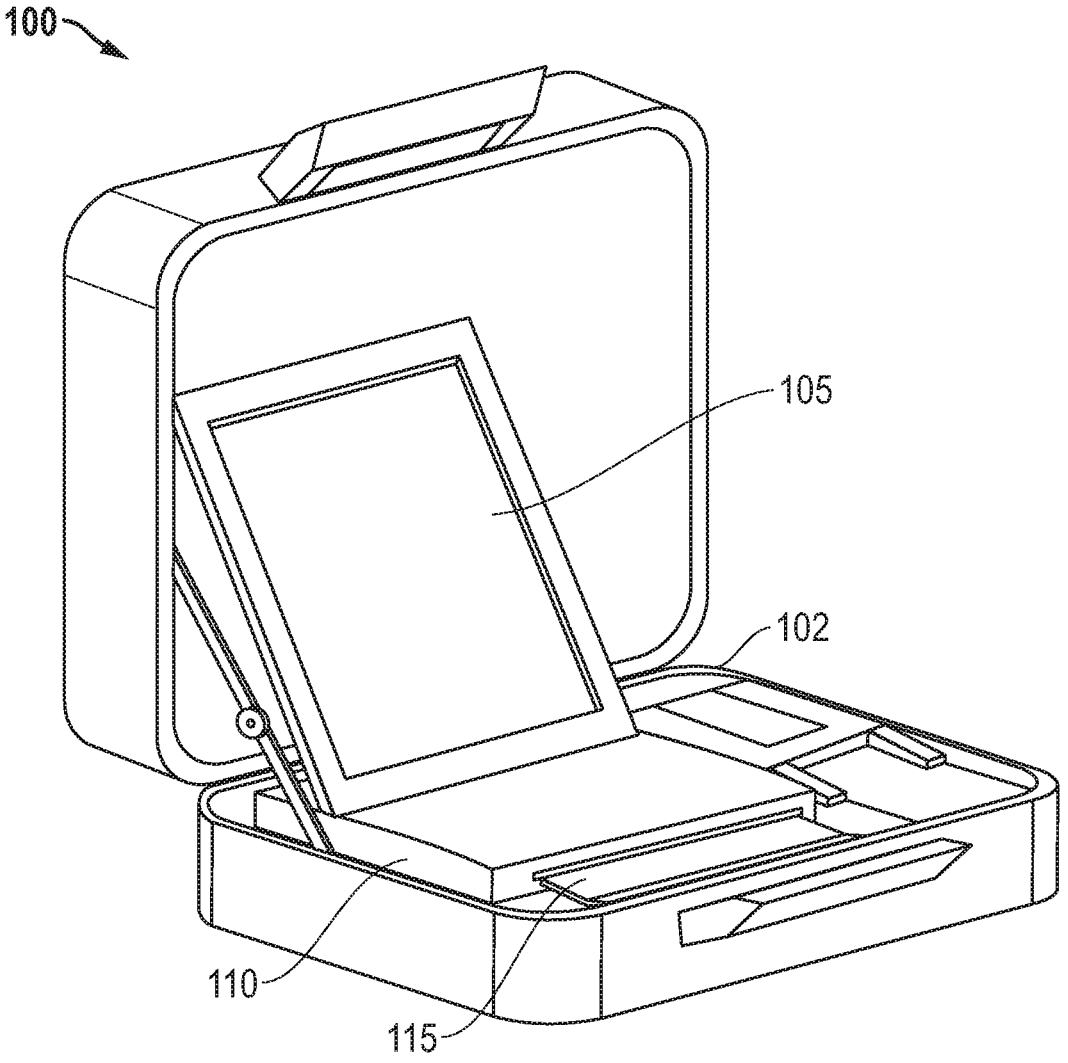
FIG. 1 (Prior Art)
FIG. 1 illustrates a prior art voting system that includes a base station and smart panel.

In one embodiment, the present disclosure describes an electronic voting system that enables transportable voting equipment. Such transportable voting equipment may be transportable and easily moved while the equipment is enabled for voting to occur. In one embodiment, the transportable voting equipment may be used to enable curbside or mobile voting in election processes in which printed vote records are required. Though the term "printed vote record" is used herein, as used herein such term references printed marked ballots also. Thus, the term printed vote records is used for ease of description below, but such usage also encompasses printed marked ballots. In this embodiment, transportable voting equipment is provided that allows poll workers to easily transport (for example to a voter in a vehicle at a curbside) voting equipment and allows the voter to independently make their vote selections, even from outside a polling location. The transportable voting equipment may include a printer to produce a printed vote record. The electronic voting system may include the use of a base station (for example located inside a polling building), transportable voting equipment, and a smart panel that is dockable and removable to/from both the base station and the transportable voting equipment. The transportable voting equipment may include a handheld carrier and a printer contained in the handheld carrier. The carrier provides a new housing for the smart panel that is customized for transport to a voter outside of a polling place (for example curbside or mobile voting). The electronic voting system may also include an audio tactile interface (ATI) controller that is transportable as part of the carrier, as part of the smart panel or as a separate stand-alone ATI controller.

In the illustrative embodiments described herein, the carrier may be configured to carry a voting device, of which a smart panel is just one exemplary example. However, the voting device held by the carrier is not limited to smart panels. For example, the voting device could be merely a CPU with memory unit that interfaces with a screen of the carrier. In this manner, the screen is part of the carrier as opposed to a smart panel which may incorporate a screen. Thus, though many embodiments described herein as shown in the example of a smart panel that is used in conjunction with a base station and a carrier, it will be recognized that such usage is merely exemplary and that the more general application is a voting device that is used in conjunction with a base station and a carrier. One of the more general applications being the situation where the carrier has a screen, thus negating the need for a voting device that has a screen.

In another embodiment, an electronic voting system includes at least three components: a base station utilized within the polling location, a carrier for use with curbside or mobile voting, and a smart panel that may dock both with the base station (for use in a polling place) and with the carrier for transport to and use in another location (for example curbside or other mobile voting locations). Further, in one particular embodiment, the electronic voting system is configured such that a printed record may be created either within the polling location or at the curbside/mobile location.

In another embodiment, transportable voting equipment is provided which comprises a carrier to which a voting smart panel may be attached and docked. The carrier may be configured in a manner that it may be presented to a voter in a manner that it is passed through a voter's open vehicle window to enable curbside voting. Moreover, the carrier may be ergonomically configured for use within a vehicle. For example, the carrier may be sized such that the carrier may be passed to a voter through an open window of a vehicle. Further, the carrier may include side handles for easy gripping the carrier. In addition, the carrier may include at least one curved end such that the carrier may rest upright on a voter's lap, for example when a voter is seated within a vehicle. The carrier may further include a printer so that a voter may receive a printed vote record while voting at a curbside/mobile location.

The electronic voting allows a voter to vote in their vehicle or at another mobile location outside of a polling station. Further, the transportable voting equipment may be provided to a voter while the voter remains in their vehicle, for example through a vehicle window. Particularly for some voters, having to vote with equipment that is maintained outside of a vehicle can be difficult and undesirable. The apparatus and techniques described herein allows the voter to use the electronic voting system within the confines of their vehicle, with a portable unit placed in the voter's lap, leaning on the dashboard, or even leaning on the steering wheel.

The transportable voting equipment may utilize a smart panel which records the voter's voting selections. As described herein in one exemplary embodiment, the smart panel may also dock with a voting base station. However, a common smart panel for use with both a voting base station within a polling location and for use at curbside/mobile locations is not required in all of the embodiments described herein. The voting base station may typically be located inside precinct polling location. The voting base station is typically used for normal, non-curbside voting. An exemplary configuration of a smart panel and base station is described herein. It will be recognized that the curbside voting techniques described herein are not limited to such a smart panel and base station configuration and the configuration described is thus merely exemplary. Thus, for example, the smart panel for use in the transportable voting equipment described herein may be dockable to a base station for use with non-curbside/mobile voting. However, alternative smart panels may be utilized which are not configured to dock with a non-curbside/mobile voting base station. Thus, the smart panel and base station configuration described is merely exemplary and the curbside/mobile voting techniques need not be limited to the configuration described below as other smart panels may be utilized.

FIG. 1 illustrates a prior art election voting system 100. The election voting system 100 may include a base station election voting device 102. The base station election voting device 102 may also include a smart panel 105, a voting processing unit 110 and a printer medium input tray 115. The smart panel 105 may be removable from the base station election voting device 102. The smart panel is configured to display voting process information (such as for example election choices for which a voter may provide a voter's selection) and act as an input device for a voter to provide voting choices. As is known in the art, the election voting system 100 may also include an audio tactile interface (ATI) controller (not shown) which may be utilized to provide accessible voting options.

The base station is configured to house the smart panel. The election voting system 100 is configured to have the smart panel 105 be removable from the base station election voting device 102 and store voting information selected while the smart panel 105 is removed from the base station election voting device 102. When docked, voting selections provided on the smart panel 105 may also be recorded on the base station election voting device 102.

The voting processing unit 110 may include a variety of hardware and software, including a memory, processors, associated election software, input devices, etc., all as is known in the art. In operation, a voter may utilize the smart panel 105 and the base station election voting device 102 together as part of the process of casting a vote in an election. The voter may be provided instructions and voting choices that are presented on the smart panel 105. Various voter responses and election selections may be entered via the display (in the case of a touchscreen display) or may entered via other inputs such as a keypad, buttons, dials, etc. that may be coupled to or part of the base station election voting device 102. The base station election voting device 102 may also include an internal printer (not shown). The printer may be utilized to print a voter's selections on a printed vote record. After printing, the printed vote record may be subsequently cast and tabulated (for example by scanning to record a voter's election selections as indicated on the printed vote record) or the printed vote record may merely be used as an audit trail of the voter's voting selections (such as in the case of a DRE system in which the voting cast vote record is electronically cast directly by the voting processing unit 110). The base station election voting device 102 may also include a printer medium input tray 115. Printer medium may be inserted into the printer medium input tray 115 for a variety of reasons, depending upon the particular voting process implemented with the election voting system 100, including for example for the printing of a printed vote record. It will be recognized, however, that the uses of a printed vote record as described herein are merely exemplary and the concepts and techniques described herein may be utilized for a wide variety of election voting systems.

The election voting system may further comprise a locking assembly to lock the smart panel 105 and a base station 112. An exemplary system including a smart panel and base station is described in U.S. patent application Ser. No. 13/967,054 filed Aug. 14, 2013 entitled "Multi-Purpose Configurable Voting System," published as U.S. Patent Publication No. 2014/0052505A1, the disclosure of which is expressly incorporated herein by reference in its entity. The election voting system 100 may be compliant with one or more versions of the Voluntary Voting System Guidelines (VVSG) as prepared by the United States Election Assistance Commission.

As mentioned, election voting system 100 is configured to have the smart panel 105 removed from base station election voting device 102. The election voting system 100 is configured to store voting information selected while smart panel 105 is removed from the base station election voting device 102. More specifically, the smart panel may store a voter's election choices made on the smart panel while the smart panel is disconnected from the base station.

Smart panel 105 may comprise one or more memories, processors, and a display. The base station election voting device 102 may also include memories and processors. Both the smart panel 105 and the base station election voting device 102 may include interconnects for connecting the two devices to each other. Smart panel 105 is an electronic device configured to display one or more of voting process information and voting information. Such information may be displayed when the smart panel is docked to the base station and may also be displayed when the smart panel is removed from the base station. Voting process information includes one or more of the status of electronic voting system and information related to candidates and issues being voted upon in an election. For example, voting process information can include whether electronic voting system/smart panel is ready to be used by a voter and can include names of candidates from which a selection may be made. Voting information may include one or more selections made by a voter regarding candidates and issues. For example, voting information may include which candidate was selected by a voter. One or more memory devices in the smart panel and/or voting device may record the voting information. The memory devices may include any of a wide range of memory devices including memory integrated circuits, memory disks and drives, removable memories (for example USB drives), etc. The memories may be used to store voting information and also store processing instructions or software for operating the electronic voting system.

The smart panel and base station may be configured to store voting results in a wide range of manners. For example, when voting occurs while the two devices are connected, the voting results may be stored in the base station. Alternatively, the voting results may be stored both in the smart panel and the base station. Further, the system may be configured such that when voting occurs on the smart panel while the smart panel is disconnected from the base station, the voting information is stored in the smart panel. Then when the smart panel and voting station are reattached, the voting information (for example a voter's election choices) may be transferred to the base station.

Figure 2:
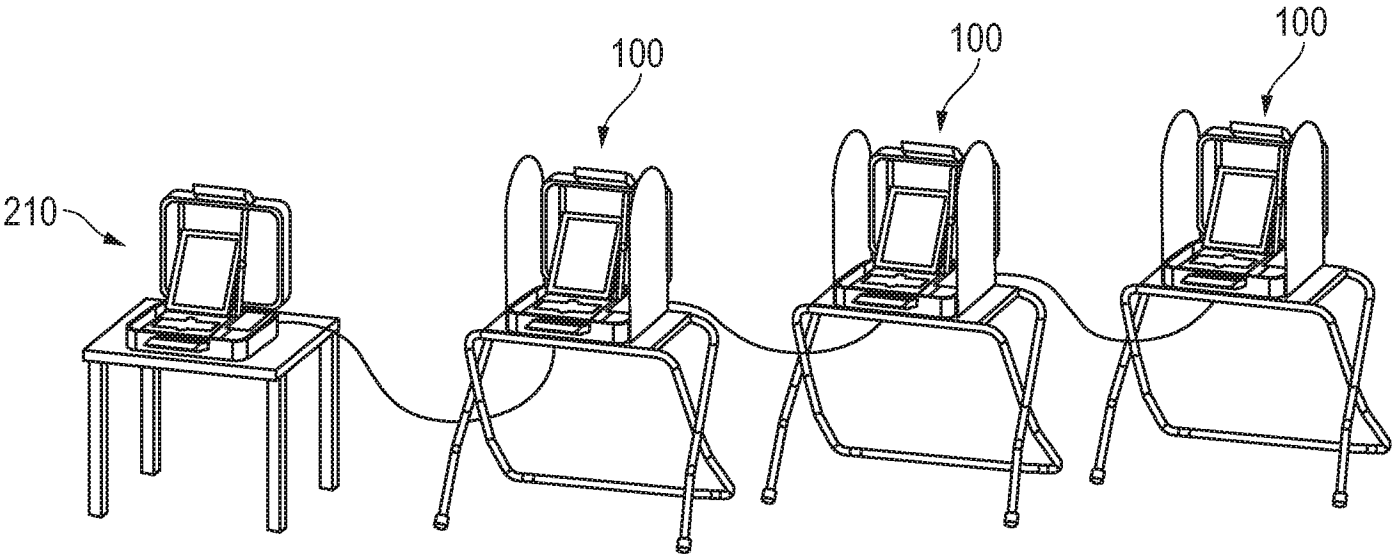
FIG. 2 (Prior Art)
FIG. 2 illustrates an exemplary networked polling location utilizing a plurality of the base stations and smart panels of FIG. 1.

The election voting system 100 may be implemented at a polling location as a stand-alone unit. Alternatively, as known in the art, multiple electronic voting systems may be network connected at a polling location. One exemplary configuration for a networked polling location is shown in FIG. 2. As shown, multiple electronic voting systems 100 are hardwire network connected. Also connected to the network is an election official station 210 which may operate as a network controller. Exemplary network connection configurations are disclosed in U.S. Pat. No. 10,438,433 issued to Canter et al. on Oct. 8, 2019, the disclosure of which is expressly incorporated herein by reference in its entirety. It will be recognized, however, that the transportable voting techniques described herein are not limited to a particular polling place configuration and the configurations described are merely exemplary. Further, though not shown, for some voting processes the network configuration may include a scanner for scanning printed vote records which are printed by the base station election voting devices 102.

Figure 3:
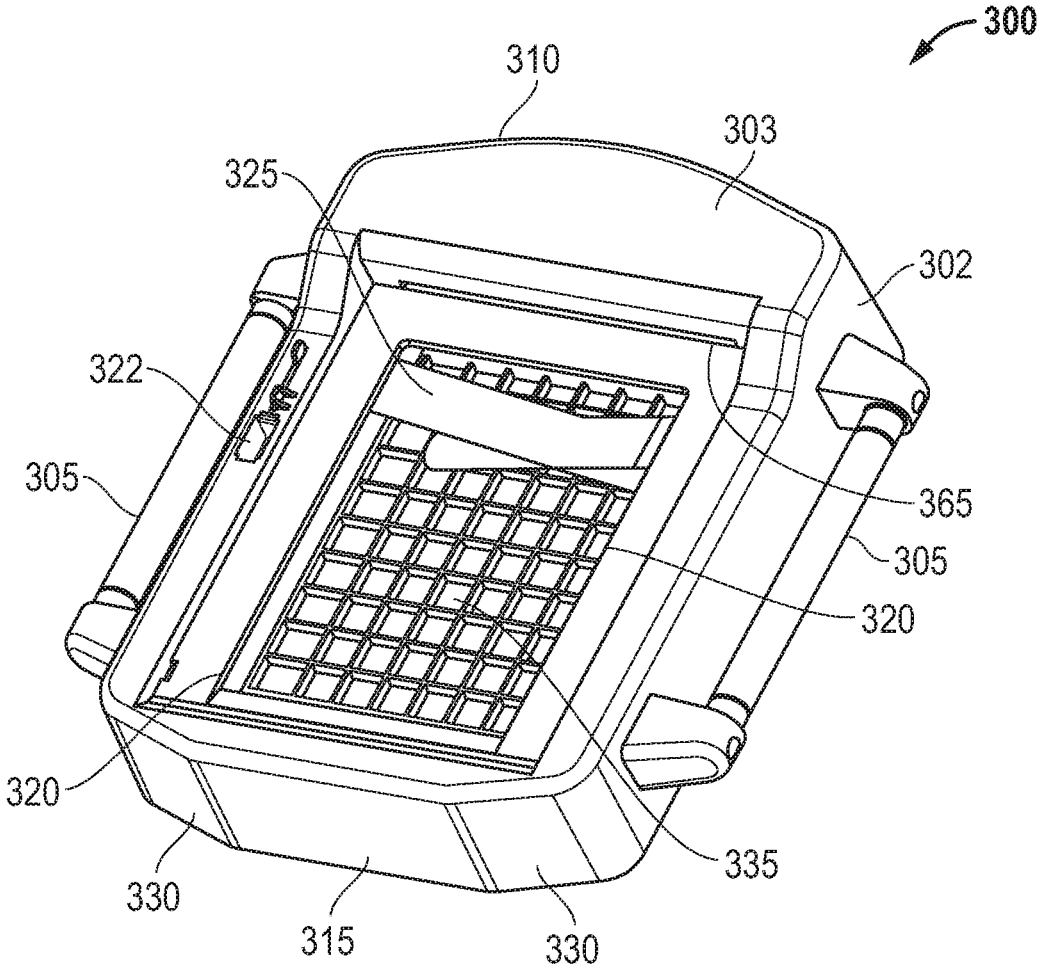
FIG. 3 provides a front perspective view of a handheld curbside/mobile voting carrier.
Figure 4:
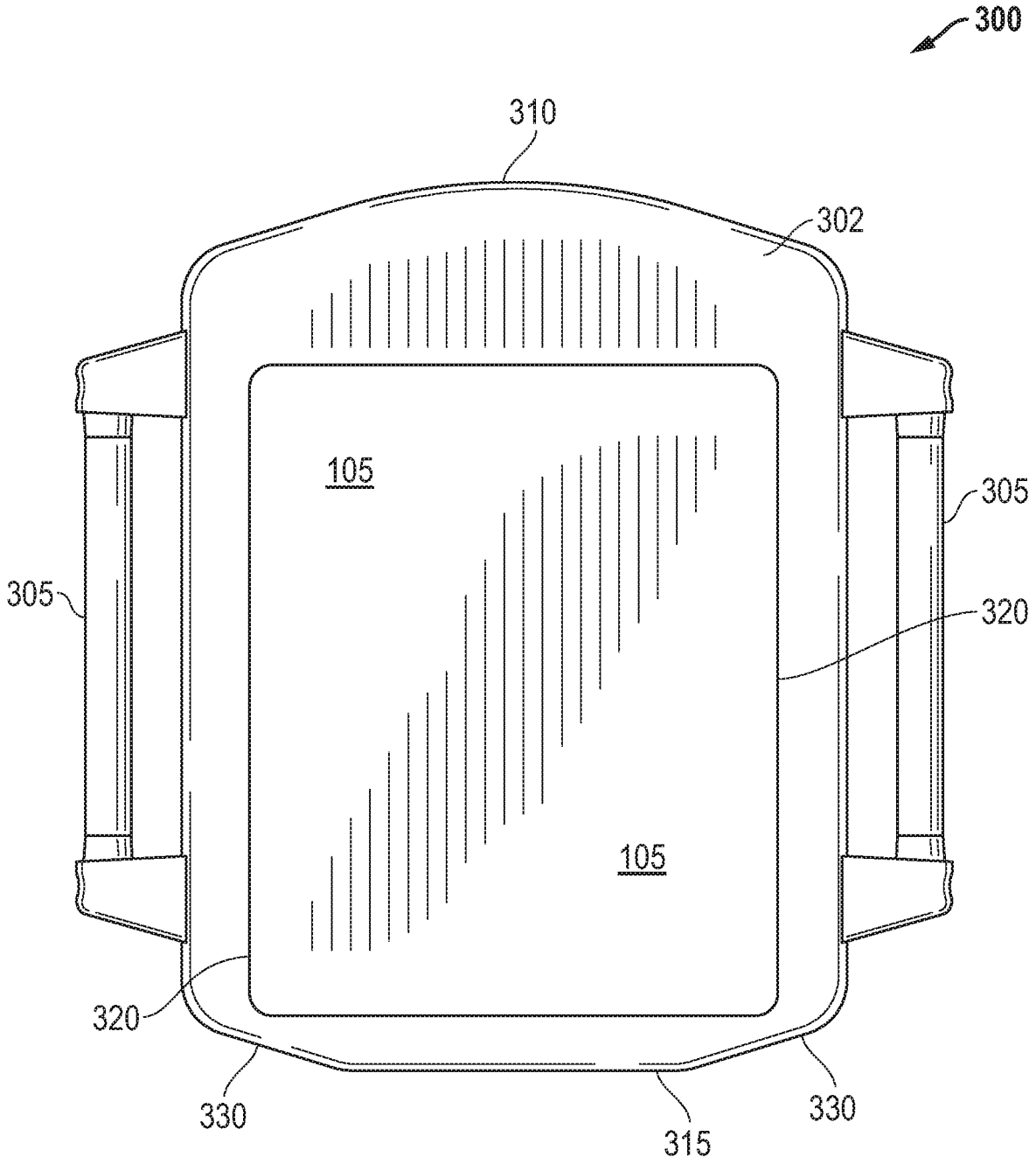
FIG. 4 provides a front view of a handheld curbside/mobile voting carrier.
Figure 5:
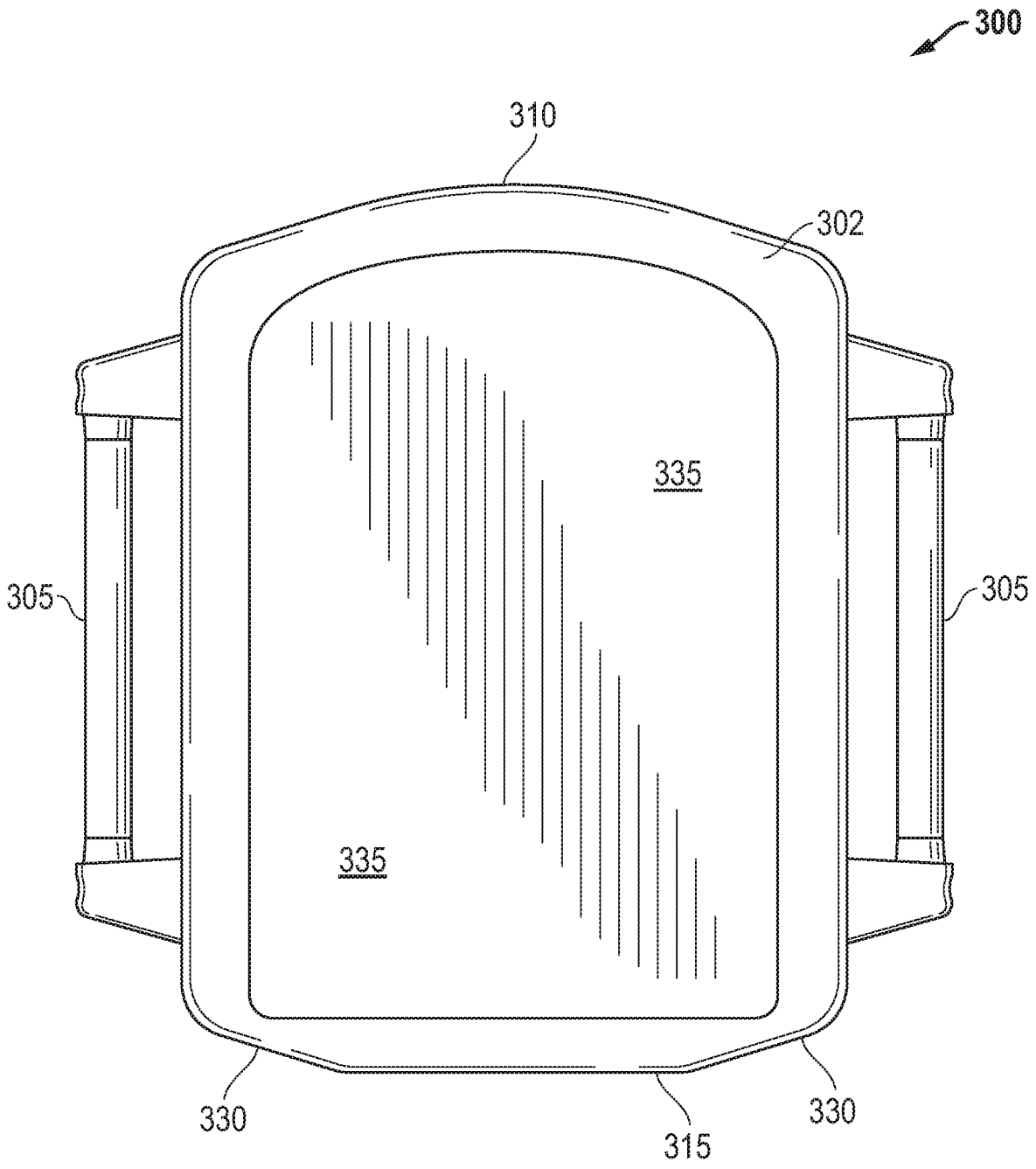
FIG. 5 provides a back view of a handheld curbside/mobile voting carrier.
Figure 6:
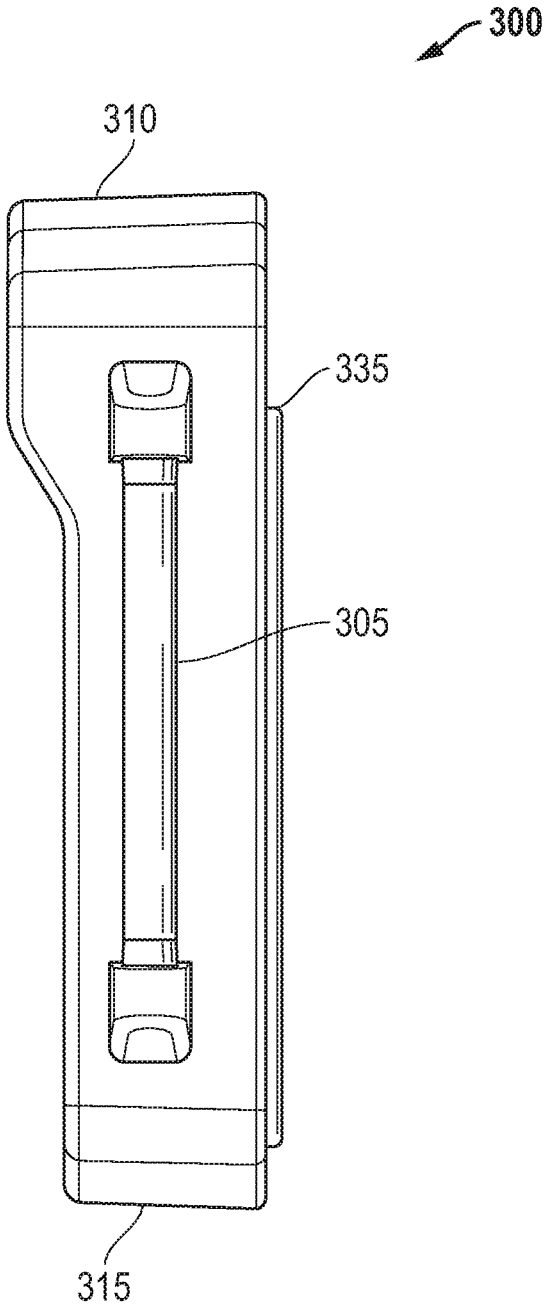
FIG. 6 provides a right side view of a handheld curbside/mobile voting carrier.
Figure 7:
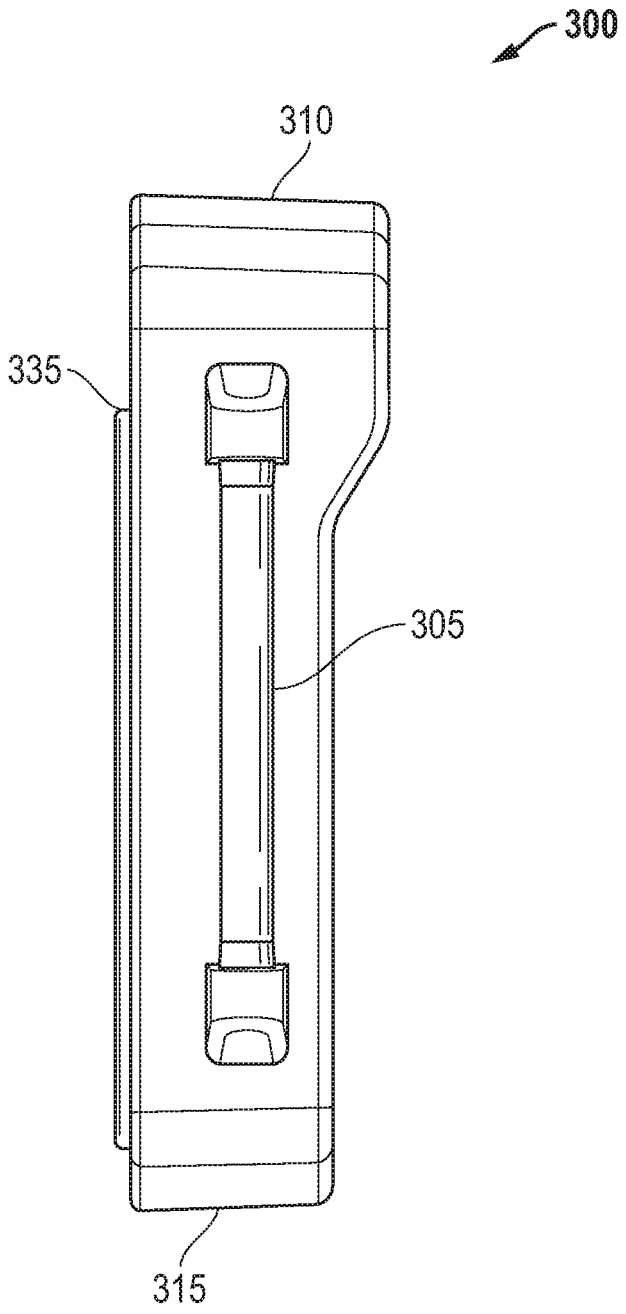
FIG. 7 provides a left side view of a handheld curbside/mobile voting carrier.
Figure 8:
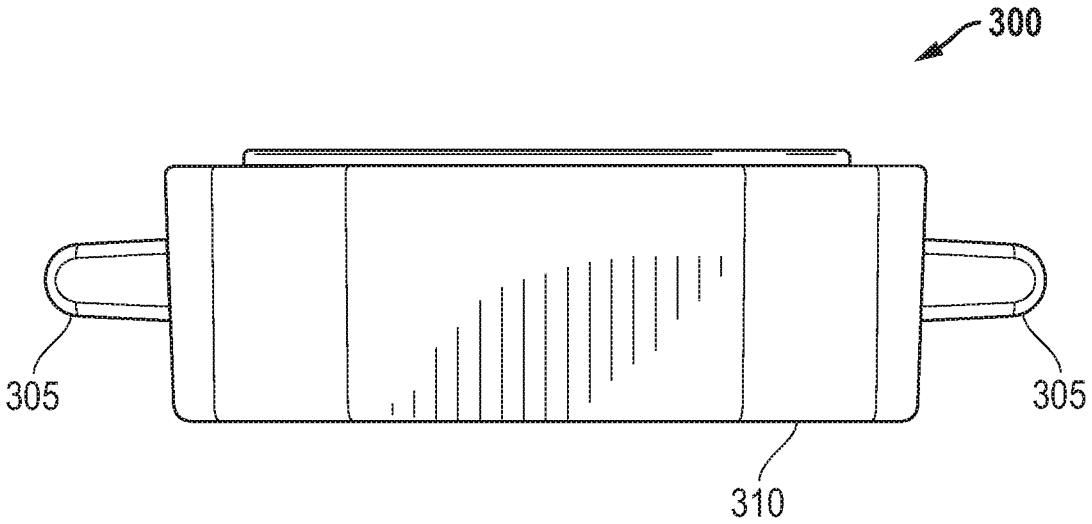
FIG. 8 provides a top view of a handheld curbside/mobile voting carrier.
Figure 9:
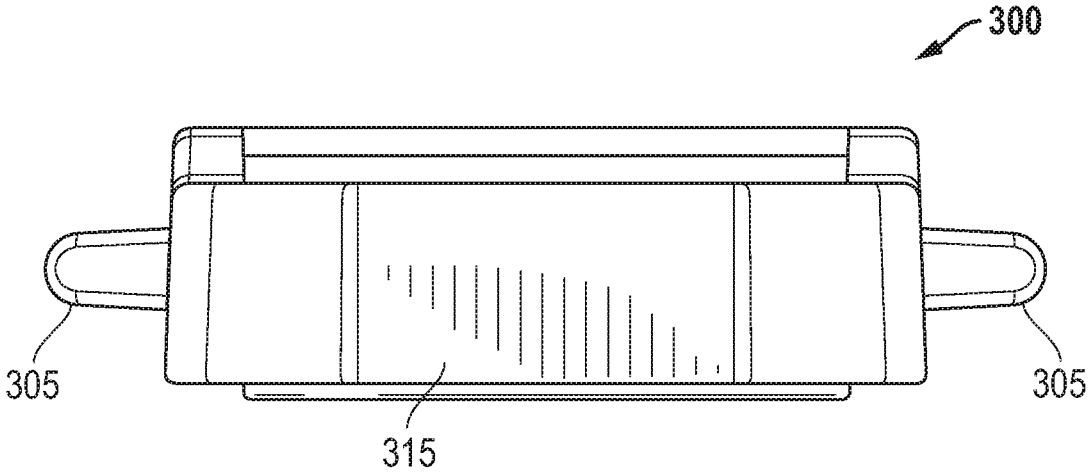
FIG. 9 provides a bottom view of a handheld curbside/mobile voting carrier.

The election voting system 100 of FIG. 1 may be converted to a curbside voting system through the addition of transportable voting equipment. FIGS. 3-9 illustrate an exemplary configuration of the transportable voting equipment which includes a handheld carrier such as carrier 300. The carrier 300 provides a mechanism to insert and carry the smart panel 105 for use when curbside/mobile voting is desired. Thus, the overall election voting system may comprise a base station election voting device 102, a smart panel 105 and a carrier 300. As to the carrier 300, FIG. 3 illustrates a perspective view of the carrier 300, FIG. 4 illustrates a front view of the carrier 300, FIG. 5 illustrates a rear view of the carrier 300, FIGS. 6 and 7 illustrate side views of the carrier 300, FIG. 8 illustrates a top view of the carrier 300 and FIG. 9 illustrates a bottom view of the carrier 300. The carrier 300 of FIG. 3 is shown in a state in which a smart panel 105 has not been inserted into the carrier 300 (insertion of a smart panel is discussed in more detail below). FIG. 4 illustrates the carrier 300 with the smart panel 105 included in the carrier 300. Thus, the carrier 300 may be configured to detachably hold the smart panel 105.

As shown in FIGS. 3-9, the carrier 300 may comprise a housing 302, handles 305, a top end 310, and bottom end 315. As shown in FIG. 3, a smart panel is not inserted in the carrier 300. An edge 320 of the front of the carrier 300 defines a smart panel opening region of the housing 302 for viewing a smart panel when a smart panel is placed in the carrier 300. As a smart panel 105 is not placed within the carrier 300 of FIG. 3, a rear door 335 of the carrier 300 may be seen in the front perspective view of FIG. 3. Also shown in FIG. 3 are straps 325 which may help secure a smart panel in the carrier 300 (insertion is discussed in more detail below). Thus, the interior of the housing 302 may comprise a cavity within which a smart panel may be inserted and held. In one embodiment, a smart panel may be inserted through the rear door and the smart panel held in the cavity formed between the rear door and the front portion of the housing. Edges 320 of the front portion of the housing 302 may be sized to conform to a screen of a smart panel 105. In this manner, the smart panel 105 may be contained within the cavity of the housing 302 while the screen of the smart panel 105 is viewable at the front of the carrier 300.

Input/output ports 322 are provided for connection of an ATI controller and headphones. An upper housing region 303 provides a region within which a printer (not visible) may be housed. The bottom end 315 may comprise shaped regions 330 as shown in FIGS. 3-5. Shaped regions 330 provide a bottom end 315 which is ergonomically friendly for voter use when the bottom end 315 rests against a user's lap. Thus, for example, if a user is using the transportable voting equipment while the user is sitting in their vehicle, the contour of the shaped regions 330 of the bottom end 315 allow the carrier 300 to comfortably rest against the user's lap.

Figure 10:
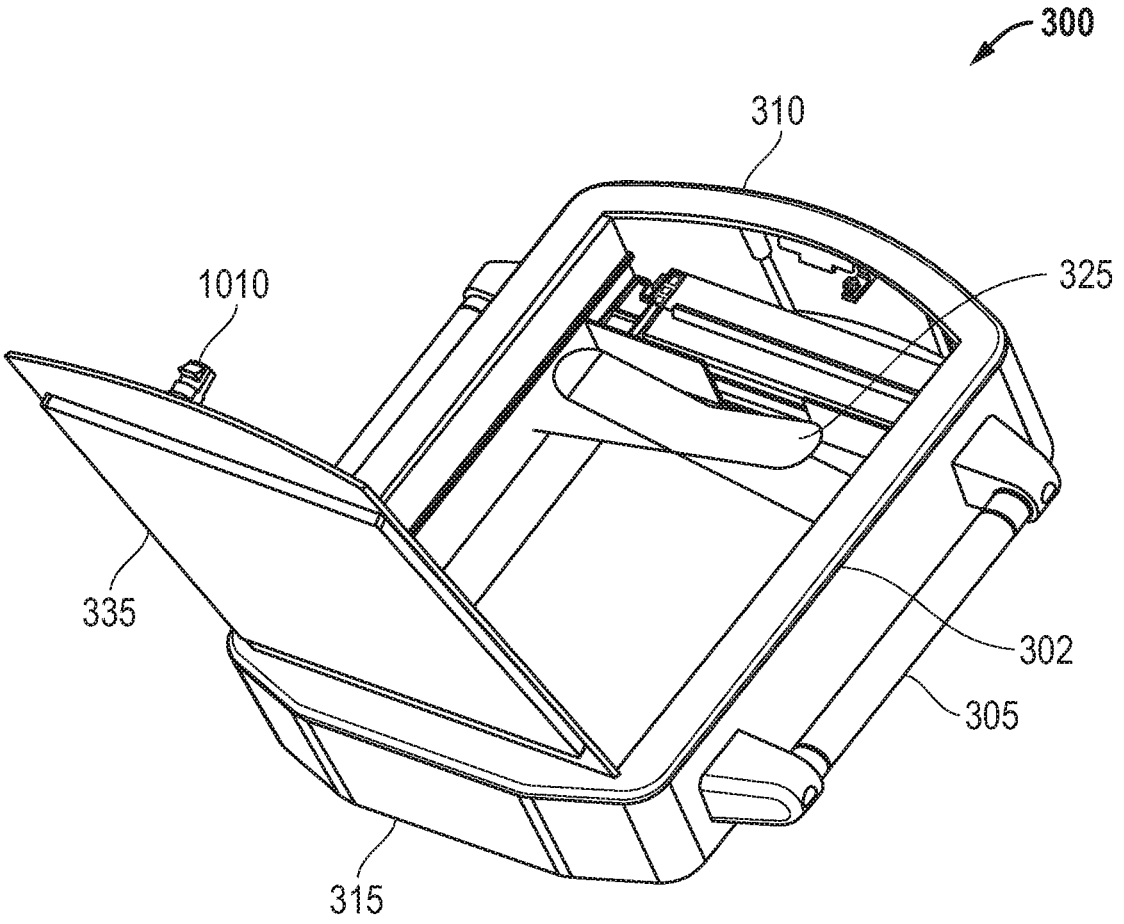
FIG. 10 provides a back view of a handheld curbside/mobile voting carrier having a rear door open.

The transportable voting equipment may be arranged so as to allow for the insertion of a smart panel 105 of the election voting system 100 into the carrier 300. As mentioned, in FIG. 3 the carrier 300 does not yet have a smart panel inserted. For insertion of a smart panel, the rear door 335 is provided. When opened, a smart panel may be inserted and then the rear door 335 closed for transport and curbside/mobile voting. FIG. 10 illustrates the carrier 300 having the rear door 335 in an open position. Latch 1010 is provided to secure the rear door 335 to the housing 302 when the rear door 335 is closed. Straps 325 may be provided to secure the smart panel 105 in the carrier 300, though any of a variety of securing mechanisms may be used, including but not limited to snaps, clips, slots, etc. The smart panel 105 is inserted such that the screen of the smart panel may be shown through the smart panel opening formed by the edges 320 on the front of the housing 302.

After insertion of the smart panel, the rear door may be swung to a closed, locked position. In this locked position, the transportable voting equipment, including the smart panel held in the carrier, is ready for use by a curbside/mobile voter. Thus, voting choices may be presented to the voter on the screen of the smart panel at a curbside/mobile location. The voter may then provide their voting selections through choices entered by the voter on the screen (for example a touchscreen). After a voter votes on the transportable voting equipment, a printed vote record of the voters election choices is printed by the printer of the carrier. The printing arrangement and presentation of the printed vote record is discussed in more detail below.

The carrier 300 is designed to be ergonomically friendly for curbside/mobile voters. Ergonomic features are particularly important for curbside voting. Ideally, the transportable voting equipment should designed such that the equipment may be passed to a voter through the voter's vehicle window and used by the voting while seated in a car. Moreover, the shape and size of the equipment should be structured that the voting may be easily accomplished in a driver's side seat, even with interference caused by a steering wheel. The carrier 300 of FIGS. 3-10 provides such ergonomic features. Thus, for example, the carrier may be constructed in a manner having a height, width, and depth that may fit through a typical vehicle window. Further, the depth may be configured such that the carrier 300 may rest on user's lap even on the driver's side where the steering wheel limits the space for placement of the carrier in the voter's lap. For example, the height of the carrier may be 20 inches or less, and even more desirably 18 inches or less. The width may be 20 inches or less, and even more desirably 18 inches or less. The depth may be 7 inches or less, and even more desirably 5 inches or less. Moreover, the carrier dimensions given may not extend across the entirety of a dimension. For example, a carrier may be 18 inches wide when including the handles but in the regions without the handles the dimensions may be only 14 inches. Further, a carrier may be 5 inches deep in the upper region where the printer is located but less than 4 inches deep for the rest of the device. Note, the figures are not necessarily shown to scale, figure to figure, so that various features may be better viewed. Portability and ease of usage may also be impacted by weight (both the weight of the carrier alone and the weight of a carrier holding a smart panel. In one embodiment, the carrier weight may be 10 pounds or less and even more desirably 7 pounds or less. In one embodiment, the combined carrier with smart panel weight may be 14 pounds our less and even more preferable 13 pounds or less. Thus, the transportable voting equipment described herein provides a relatively compact curbside/mobile voting solution in which the equipment provided has a depth which is significantly smaller than the other dimensions. For example the depth may be 40% smaller than the next smaller dimension and more preferably 30% smaller or less. As mentioned, the minimization of the depth is particularly important for ease of use when the carrier 300 is placed on a user's lap in front of a steering wheel of a vehicle.

The shaped regions 330 of the bottom end 315 of the carrier 300 also provide beneficial ergonomic advantages. By having shaped regions at the edges of the bottom end, the carrier 300 will better rest in a user's lap. The shaped regions generally "cut-out" the edges at the corner that would have been formed between the bottom end 315 and the sides of the carrier. The shaped regions may be chamfered, curved, rounded, etc. in nature. In this manner, the corners of the carrier may be cutout, thus providing the carrier with cutout corners at the transition from the bottom of the carrier to the sides of the carrier. In addition to providing use advantages when resting in a user's lap, the shaped regions further reduce the overall size of the carrier, thus assisting in passing the carrier through a vehicle window.

Handles 305 provide a number of further ergonomic advantages. The handles 305 assist in carrying the carrier 300, lessening the chances of a poll worker or voter dropping the carrier. Further the handles provide a more secure grip area when the carrier is being hand-off between two people, particularly for the transfer from a poll worker to a voter through the voter's vehicle window. Also, the handles provide a mechanism in which the voter may hold the carrier when voting, for example a voter may hold one handle with one hand while using the other hand to make selections on the screen of the smart panel. Moreover, large handles are provided to allow for a large area to grip the carrier. In some embodiments, the handles may have a length that is over 50% of the height of the carrier, and in some cases even over 75% of the height of the carrier.

Though generally, curbside/mobile voting is often envisioned outside of a polling facility, it is noted that the ergonomic advantages described above are equally applicable to a voter which has accessibility limitations which cause difficulties when using a polling locations standard voting stations. Thus, as used herein, mobile voting is not limited to voting that occurs outside of a polling location, but may further include voting in which the smart panel is removed from the base station and moved to a voter, independent of whether that voter is inside or outside the polling facility.

As mentioned above, the transportable voting equipment described herein may be utilized in voting processes which require the production of a printed vote record. Thus, the transportable voting equipment may include a printer. The printer may be provided in any location of the carrier. In one embodiment shown in the figures, the printer is located at an upper housing region 303 of the housing 302 of the carrier 300. In one exemplary embodiment, the printer is a thermal printer. However, other printers and printer locations may be utilized.

Thus, the carrier 300 may include a printer which provides a printed vote record for review by the voter. In the exemplary embodiment shown herein, the printer may be housed in the top end of the carrier 300. The carrier may be configured such that paper may be inserted with each use of the carrier or the carrier may be configured such that it stores paper (in sheet or roll form). In one exemplary embodiment, paper may be inserted and loaded through the rear door 335 in a pocket for paper placement after the smart panel is inserted in the carrier. Thus, for example, the paper may be placed behind smart panel for each particular voter in a manner such that the printer may then access the paper when time comes to print that voter's printed vote record. When paper is inserted and the rear door 335 closed, an enclosed paper path is provided so that the paper is protected to ensure the voter's usage of the transportable voting equipment does not dislodge the paper. Such a paper placement is merely exemplary, and as mentioned other ways of storing paper may be used, such as for example, pre-loading paper rolls or multiple sheets of paper for use with multiple voters.

Figure 11:
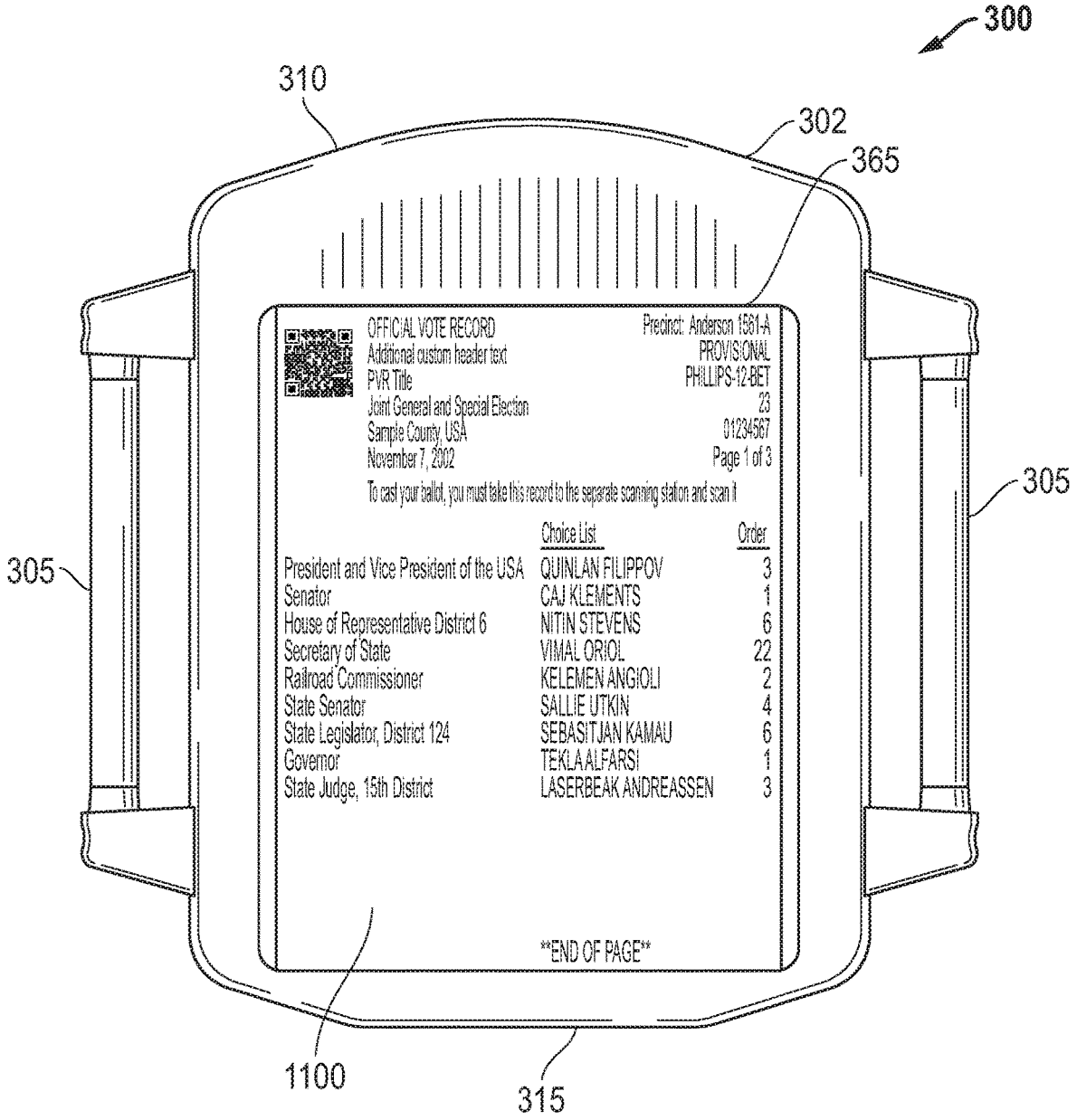
FIG. 11 provides a front view of a handheld curbside/mobile voting carrier having a printed vote record ejected from a printer of the handheld curbside/mobile voting carrier.
Figure 11A:
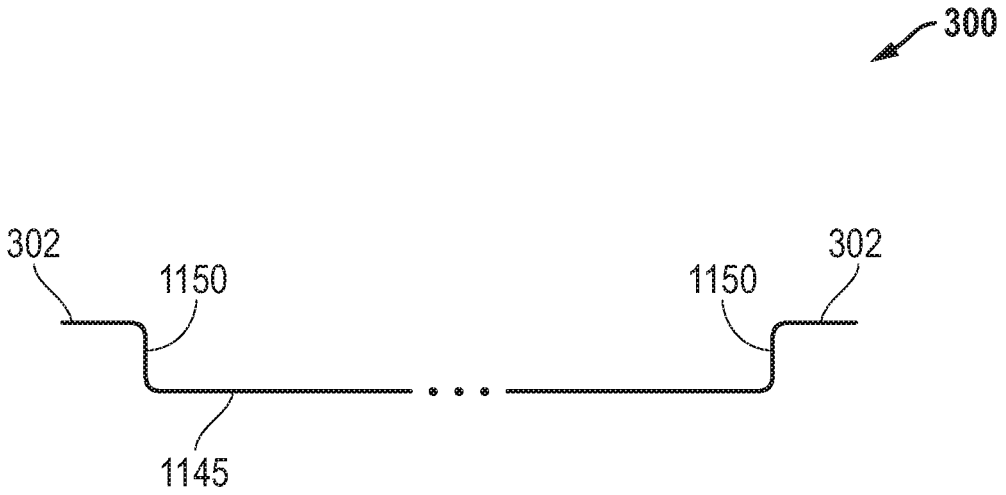
FIG. 11A provides a cross-sectional view of a handheld curbside/mobile voting carrier showing housing edges comprising sidewalls which help form a printed vote record paper landing area.
Figure 11B:
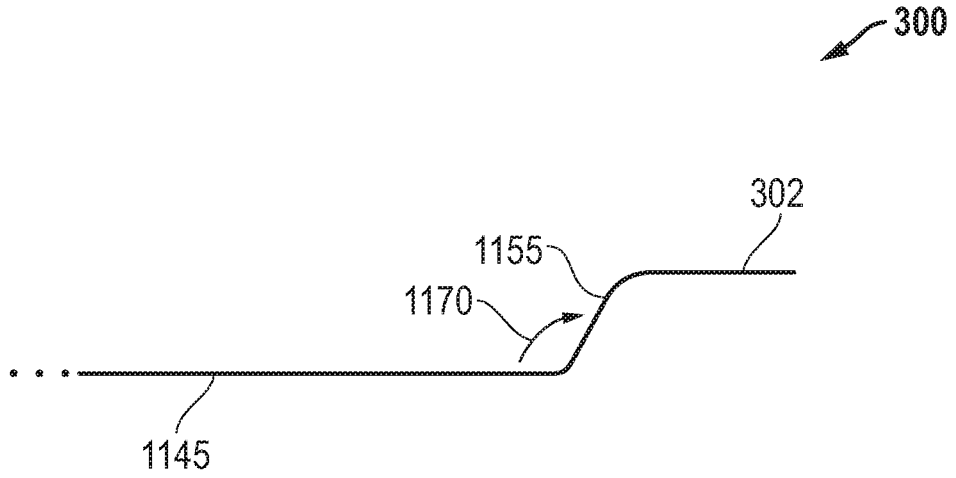
FIG. 11B provides a cross-sectional view of a handheld curbside/mobile voting carrier showing a housing edge that comprises a bottom wall which help form a printed vote record paper landing area.

In one embodiment, the printed paper is ejected from the printer down in front of the smart panel screen at the front of the carrier and held at that location. Thus, the printed paper is placed in the same location as the screen location. FIG. 11 illustrates a printed voter record 1100 which is presented to the voter on the front of the carrier 300 in front of the smart panel screen. Thus, the printed vote record is presented to the voter over the top of the smart panel while the smart panel remains inserted in the carrier. A printer output slot 365 is shown in FIGS. 3 and 11 through which a printed vote record may be ejected. In this manner, the printed vote record is provided to the user in a location that is easy to read and review, right in front of the smart panel screen. Edges, slots, clips, tabs, recesses, etc. may be provided at the front of the carrier 300 to catch and hold the paper right in front of the smart panel screen. In this manner, the transportable voting equipment may be used in a manner that the voter may view printed vote record without having to separately hold the carrier and the printed vote record. Such holding of the printed vote record further enhances the ergonomics of use of the transportable voting equipment, particular in tight quarters such as driver's side seat of a vehicle. One embodiment for holding paper ejected from the printer output slot 365 is shown in FIGS. 11A and 11B. FIG. 11A provides a cross-sectional view of a handheld curbside/mobile voting carrier showing housing edges comprising sidewalls which help form a printed vote record paper landing area. FIG. 11B provides a cross-sectional view of a handheld curbside/mobile voting carrier showing a housing edge that comprises a bottom wall which help form a printed vote record paper landing area. As shown In FIG. 11A, a paper landing area for holding the paper is formed by a screen 1145 of the smart panel 105 and housing edges 1150 of the housing 302 which form sidewalls of the paper landing area. As shown in FIG. 11B, the paper landing area for holding the paper is further formed of angled housing bottom edge 1155 of the housing 302 which forms a bottom wall of the paper landing area. In this manner the sidewalls and bottom wall may retain paper that is ejected from the printer output slot 365. The angled housing edge 1155 which provides the bottom wall may be formed at an angle 1170 with respect to the screen 1145. Angle 1170 may be more than 90 degrees as shown to aid in removing the paper if desired.

Figure 12:
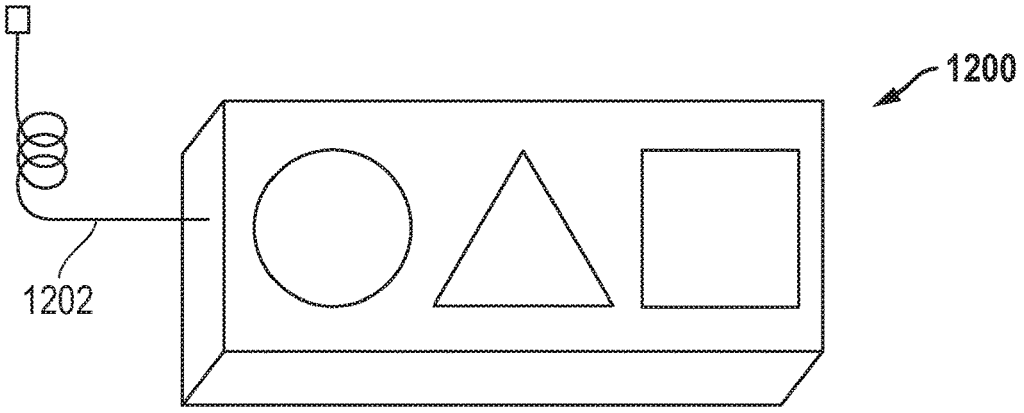
FIG. 12 illustrates an audio tactile interface (ATI) controller that may be used with a handheld curbside/mobile carrier.

As mentioned above, an ATI controller may be utilized to further enhance the accessible voting features of the election voting system described herein. As known in the art, ATI controllers provide more accessible voting for voters which may encounter difficulties with screens for any of a variety of reasons. In one embodiment, the ATI controller may be a unit that is separate from the carrier. Thus, the transportable voting equipment may include a carrier (with a smart panel inserted) and a separate ATI controller. In another embodiment, the ATI controller may be formed integrally with the carrier so a separate ATI controller is not needed. FIG. 12 illustrates a separate ATI controller 1200 which may be utilized with the carrier and smart panel through use of a communication cable 1202 (in one example a USB communication line). In one embodiment, the communication cable 1202 may be connected to the carrier 300 through the input/output ports 322 (shown in FIG. 3) of the carrier.

Figure 13:
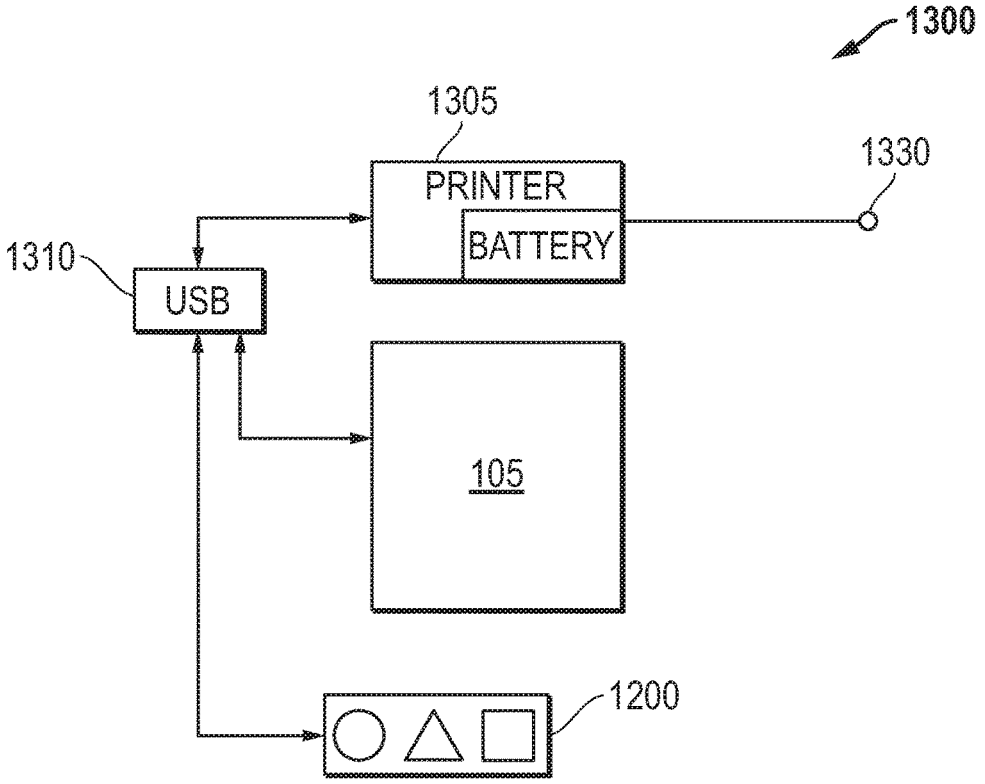
FIG. 13 illustrates a high level functional block diagram 1300 of the electrical coupling configuration of handheld curbside/mobile voting equipment.

FIG. 13 illustrates one exemplary a high level functional block diagram 1300 of the electrical coupling of the transportable voting equipment. It will be recognized that the configuration of FIG. 13 is merely exemplary and many other configurations may be utilized. As shown, a smart panel 105 (inserted in the carrier) is coupled to a USB hub 1310 of the carrier 300. The printer 1305 (contained within the carrier 300) is also coupled to the USB hub 1310. Thus, the smart panel and the printer may be in electrical communication through an electrical communication bus. The ATI controller 1200 (either embedded in the carrier 300 or a separate stand-alone unit coupled through input/output ports 322 through the use of communication cable 1202) is also coupled to the USB hub 1310. In one embodiment shown, no power subsystem is utilized in the carrier 300 as the power may be provided by the smart panel 105 and/or an embedded rechargeable battery 1320 contained within the printer 1305 (for example a lithium ion battery). Power may be provided to the rechargeable battery 1320 for recharging through power connection 1330 which may be coupled to an external AC/DC power block. Alternatively, the carrier may have its own battery based power subsystem which may provide power to the various components. The smart panel 105 may be connected to the USB hub 1310 through the use of a USB pigtail cable that is manually attached to the smart panel when the smart panel 105 is inserted in the carrier 300. Alternatively, the carrier 300 may have a docking port which the smart panel directly docks to so as to provide USB communication to the other components.

An exemplary workflow for use of an election voting system which includes a transportable voting station will now be described. It will be recognized that the described workflow is merely exemplary and other workflows may incorporate some or all of the advantageous techniques for easily implementing transportable voting (for example curbside voting) described herein.

In an exemplary voting workflow, the workflow may proceed as:

1. A poll worker is notified of a curbside/mobile voter request at time of voter check-in. Such notification may be via a proxy.
2. A poll worker activates the voting session at a smart panel device that is docked to a base station (thus the smart panel is currently docked to the base station as it would be used in a non-curbside voting scenario).
3. Once the poll worker activates the voting session for this curbside/mobile voter, the smart panel is unlocked and removed from the base station (undocked). The software of the smart panel may be active. However, the smart panel is in a locked state which does not allow voting.
4. The poll worker will insert the smart panel into the curbside/mobile carrier.
5. On insertion of the smart panel into the carrier, the poll worker will connect a USB pigtail cable from the carrier into a USB connector on the smart panel (or alternatively plug the smart panel in a docking connection of the carrier). The pigtail cable connects the smart panel to the carrier and the pigtail cable couples the smart panel to any peripherals through a USB hub, for example: (1) a thermal printer (located at the top of the carrier, just above the smart panel), and (2) the ATI controller, for accessible voting (whether embedded in the carrier or separately attached to the carrier)

6. On the smart panel's detection of printer and ATI connectivity, the software of the smart panel will inform the poll worker to insert the blank thermal sheet into the printer. The poll worker than closes the back door of the carrier to secure the paper.

7. Once the paper is inserted into the unit, the voting session is now active for the voter. The poll worker hands the carrier to the voter so that the voter may commence voting activities.

8. The voter will then use the smart panel contained in the carrier to independently make their voting selections. Once selections are made, the printer will print the printed vote record, which will print out and be provided over the top of the smart panel for presentation and review by the voter.

9. In the case of printed vote records that are subsequently to be scanned, on completion of the review by the voter, the poll worker transports the printed voter record back to the polling place to scan the printed sheet.

10. The smart panel is then re-docked and locked into the base station, awaiting the next voting session. Upon re-docking, the smart panel may pass electronic information regarding the curbside voting session to the base station and/or a network controller at the polling place.

When the election voting system includes transportable voting equipment as described herein, a number of desirable features are present. For example, some of the features include:

1. Transportable voting equipment with a removable smart panel (thus providing a removable CPU), with a built-in thermal printer and accessible unit connectivity;
2. Easy grip handles for easy lightweight transport to/from the curb from/to the polling building;
3. Locking cradle to place the removable smart panel into from the voting device base station;
4. Paper placement within a protected pocket, with door, to ensure that the voter's usage of the station does not interfere with the paper flow when printing, eliminating possible paper skew or jams;
5. Paper path elements to guide and hold the paper for the voter without the paper falling onto floor or ground (or floorboards) and the printed vote record is presented to the voter over the smart panel with voter selections side up so they can review their selections;
6. Ergonomic design that provides ease of transport to and from a voter, including through a voter's vehicle window;
7. Ergonomic design that provides for comfortable lap placement of the carrier;
8. Ergonomic design that provides for ease of use in a driver's side seat of a vehicle; and
9. Ergonomic design for holding the carrier while voting and while reviewing a printed vote record.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms and methods of the invention herein shown and described are to be taken as presently preferred embodiments. Equivalent techniques may be substituted for those illustrated and described herein and certain features of the invention may be utilized independently of the use of other features, all as would be apparent to one skilled in the art after having the benefit of this description of the invention

What is claimed:

1. Transportable election voting equipment, comprising
- a handheld carrier, the handheld carrier sized to pass through a vehicle window;
- a housing of the handheld carrier, the housing configured to detachably hold a voting device comprising a screen;
- a printer contained within the housing of the handheld carrier, wherein the printer is in electrical communication with the voting device when the voting device is held in the handheld carrier; and
- a printer output slot located within the housing of the handheld carrier, wherein the printer output slot is configured to eject a printed vote record or a marked ballot provided by the printer in front of the screen of the voting device.

2. The transportable election voting equipment of claim 1, wherein the voting device is a smart panel having the screen.

3. The transportable election voting equipment of claim 1, wherein a bottom end of the housing of the handheld carrier is ergonomically configured for resting on a voter's lap.

4. The transportable election voting equipment of claim 1, wherein a bottom end of the housing of the handheld carrier has shaped regions that provide cutout corners of the bottom end.

5. The transportable election voting equipment of claim 4, wherein the cutout corners provide a transition from the bottom end of the housing to a left side of the housing and a right side of the housing.

6. The transportable election voting equipment of claim 4, wherein the shaped regions are chamfered regions.

7. The transportable election voting equipment of claim 4, wherein the shaped regions are curved regions.

8. The transportable election voting equipment of claim 1, wherein the housing contains a cavity for holding the voting device.

9. The transportable election voting equipment of claim 8, wherein the housing further comprises a rear door providing access to the cavity when the rear door is opened.

10. The transportable election voting equipment of claim 1, further comprising a paper landing area formed by edges of the housing to receive the printed vote record or the marked ballot after ejection from the printer output slot.

11. The transportable election voting equipment of claim 10, wherein a bottom edge of the paper landing area is angled more than 90 degrees with respect to the screen.

12. The transportable election voting equipment of claim 1, wherein the handheld carrier has at least one side handle.

13. The transportable election voting equipment of claim 12, wherein the handheld carrier has two side handles.

14. The transportable election voting equipment of claim 13, wherein the two side handles extend at least 50% of a top to bottom length of the handheld carrier.

15. The transportable election voting equipment of claim 12, wherein the at least one side handle extends at least 50% of a top to bottom length of the handheld carrier.

16. The transportable election voting equipment of claim 1, wherein a height of the handheld carrier is 20 inches or less, a width of the handheld carrier is 20 inches or less and a depth of the handheld carrier is 5 inches or less.

17. The transportable election voting equipment of claim 1, wherein a depth of the handheld carrier is 5 inches or less.

18. The transportable election voting equipment of claim 1, wherein the printer output slot is configured to eject the printed vote record or the marked ballot from a front side of the handheld carrier.

19. The transportable election voting equipment of claim 1, wherein the housing of the handheld carrier further comprises a rear door, wherein the rear door provides access through which paper for the printer is loaded when the rear door is opened, and wherein an enclosed paper path is provided within the housing of the handheld carrier when the rear door is closed.

20. Transportable election voting equipment, comprising a handheld carrier, the handheld carrier configured to detachably hold a voting device having a screen, the handheld carrier having a bottom end, a top end, a left side and a right side;

a printer housed within the handheld carrier, the printer configured to provide a printed vote record or a marked ballot;

a printer output slot located within the housing of the handheld carrier, wherein the printer output slot is configured to eject the printed vote record or the marked ballot in front of the screen of the voting device;

a shaped region of the bottom end of the handheld carrier, the shaped region providing cutout corners on the bottom end to allow for the bottom end of the handheld carrier to be shaped for resting in a voter's lap; and at least one side handle on either the left side or the right side of the handheld carrier.

21. The transportable election voting equipment of claim 20, wherein the voting device is a smart panel having the screen.

22. The transportable election voting equipment of claim 20, wherein the cutout corners provide a transition from the bottom end of the handheld carrier to the left side of the handheld carrier and the right side of the handheld carrier.

23. The transportable election voting equipment of claim 20, wherein the shaped regions are chamfered regions.

24. The transportable election voting equipment of claim 20, wherein the shaped regions are curved regions.

25. The transportable election voting equipment of claim 20, the handheld carrier comprising a cavity for holding the voting device.

26. The transportable election voting equipment of claim 25, the handheld carrier further comprising a rear door on a rear side of the handheld carrier, the rear door providing access to the cavity when the rear door is opened.

27. The transportable election voting equipment of claim 25, the handheld carrier further comprising an opening within a front side of the handheld carrier for viewing the screen of the voting device when the voting device is held in the cavity.

28. The transportable election voting equipment of claim 20, wherein the handheld carrier has two side handles, one on the left side and one on the right side of the handheld carrier.

29. The transportable election voting equipment of claim 28, wherein the two side handles extend at least 50% of a top to bottom length of the handheld carrier.

30. The transportable election voting equipment of claim 20, wherein the at least one side handle extends at least 50% of a top to bottom length of the handheld carrier.

31. The transportable election voting equipment of claim 20, wherein a height of the handheld carrier is 20 inches or less, a width of the handheld carrier is 20 inches or less and a depth of the handheld carrier is 5 inches or less.

32. The transportable election voting equipment of claim 20, wherein a depth of the handheld carrier is 5 inches or less.

33. The transportable election voting equipment of claim 20, the handheld carrier further comprising an electrical communication bus, wherein the printer is in electrical communication with the voting device via the electrical communication bus when the voting device is held within the handheld carrier.

34. The transportable election voting equipment of claim 20, wherein the printer output slot is located within the housing so that the printed vote record or the marked ballot provided by the printer is ejected from a front side of the handheld carrier.

* * * * *